US006885352B2

(12) United States Patent
Lee et al.

(10) Patent No.: US 6,885,352 B2
(45) Date of Patent: Apr. 26, 2005

(54) WIRELESS COMMUNICATIONS ANTENNA ASSEMBLY GENERATING MINIMAL BACK LOBE RADIO FREQUENCY (RF) PATTERNS

(75) Inventors: Hyo-Jin Lee, Seoul (KR); Myung-Duk Kim, Gyeonggi-Do (KR)

(73) Assignees: LG Electronics Inc., Seoul (KR); LG Telecom, Ltd., Seoul (KR)

( * ) Notice: Subject to any disclaimer, the term of this patent is extended or adjusted under 35 U.S.C. 154(b) by 22 days.

(21) Appl. No.: 10/123,040

(22) Filed: Apr. 15, 2002

(65) Prior Publication Data

US 2003/0095076 A1 May 22, 2003

(30) Foreign Application Priority Data

Nov. 16, 2001 (KR) ..... 2001/71506

(51) Int. Cl.[7] ..... H01Q 19/185; H01Q 21/10

(52) U.S. Cl. ..... 343/836; 343/814; 343/817; 343/838; 343/891

(58) Field of Search ..... 343/813, 815–18, 343/817, 819, 834–838, 841, 890–892, 818

(56) References Cited

U.S. PATENT DOCUMENTS 2,880,418 A * 3/1959 Stohr ..... 343/815
3,475,758 A * 10/1969 Vito ..... 343/795
5,440,318 A * 8/1995 Butland et al. ..... 343/814
5,710,569 A * 1/1998 Oh et al. ..... 343/817
5,896,107 A * 4/1999 Huynh ..... 343/817

FOREIGN PATENT DOCUMENTS

| | | | |
|---|---|---|---|
| JP | 57-020002 | 2/1982 | H01Q/19/18 |
| JP | 2000-307337 | 11/2000 | H01Q/21/06 |
| JP | 2002-261540 | 9/2002 | H01Q/13/08 |

* cited by examiner

*Primary Examiner*—Michael C. Wimer
(74) *Attorney, Agent, or Firm*—Lee, Hong, Degerman, Kang & Schmadeka, P.C.

(57) ABSTRACT

An antenna assembly for wireless communications has various components to minimize signal influence when transmitting signals to minimize undesirable loop formation phenomena caused by (positive) feedback of signals. Signal wave scattering and diffraction causing back lobe radio frequency (RF) patterns are minimized by a particular antenna assembly structure having a reflector and at least one attenuating structural member, a metallic mesh wrapping the power cable of a feeder, a non-conductive antenna support structure, or any combination thereof. The dimensions of the various components, in particular the reflector and attenuators, can be varied according to desired wireless communications environment.

37 Claims, 6 Drawing Sheets

WIRELESS COMMUNICATIONS ANTENNA ASSEMBLY GENERATING MINIMAL BACK LOBE RADIO FREQUENCY (RF) PATTERNS

CROSS REFERENCE TO RELATED ART

This application claims the benefit of Korean Patent Application No. 2001-71506, filed on Nov. 16, 2001, the contents of which is hereby incorporated by reference in its entirety.

TECHNICAL FIELD

The present invention generally relates to wireless communications, and in particular, to a wireless communications system employing a particular antenna assembly structure that generates minimal back lobe radio frequency (RF) patterns.

BACKGROUND ART

Wireless communications involving the transmission and reception of data packets and other types of information via wireless, cellular and/or mobile techniques provide the backbone of our information society with widespread business and non-business applications. Hereinafter, such techniques will be simply referred to as "mobile communications" merely for the sake of brevity.

In a typical mobile communications system, a plurality of mobile stations (e.g., cellular/mobile phones, laptop computers, personal digital assistants (PDAs), etc.) are served by a network of base stations, which allow the mobile stations to communicate with other components in the communications system.

Mobile communications systems can include cellular, personal communication services (PCS), Global System for Mobile communications (GSM), IMT-2000 and the like. Each type of system employs an air-interface standard, such as Code Division Multiple Access (CDMA), Time Division Multiple Access (TDMA), Frequency Division Multiple Access (FDMA), etc., which are multiple access methods. These types of systems are characterized by the bandwidths used during signal transmissions.

Mobile communications systems and standards can be classified as $1^{st}$ generation analog type systems, $2^{nd}$ generation digital type systems (2G), and $3^{rd}$ generation upgraded digital type systems (3G). Two popular standards of the digital type 2G mobile communications systems include GSM systems that use TDMA as its air interface technology, and CDMA systems that use CDMA technology.

The 3G mobile communications standards are known as IMT-2000 or Universal Mobile Telecommunications System (UMTS), which reflect various enhancements and improvements of 2G mobile communications systems that are specified and standardized by two standardization bodies, i.e., the Third Generation Partnership Project (3GPP) and the Third Generation Partnership Project Two (3GPP2). The 3G mobile communications standards are not yet fully deployed as commercial systems, but are expected to be commercialized in the near future.

The service area of typical mobile communications system is divided into many cells. The system is called as "cellular system". Each cell of a cellular system has its own coverage area and has at least one base station connected to the overall communications network. However, the base station cannot cover all portions of its service area with the same performance. A mobile station and a base station may have difficulties in establishing proper signal links therebetween due to many different reasons. For example, signal interference or obstruction may result from terrain characteristics or various obstacles such as buildings. The mobility characteristics of the mobile station may cause difficulties in establishing and maintaining communication links. To prevent communication disruptions, one or more repeaters may be placed within appropriate regions of a cell so that signal transmissions between mobile stations and base stations are improved.

Typically, a repeater (or a repeater system) may be needed to support the base station to communicate with a mobile station in certain regions within the service area. A repeater may be used in a mobile communications system for relaying and/or boosting signals between a mobile station and a base station. Thus, within a cell, there can be a base station with additional repeaters that amplify and transfer the base station signals to the mobile stations.

Here, it should be noted that there are several types of repeaters. Depending upon the type of link being established with the base station, repeaters can be a fiber optic repeater or a radio frequency (RF) repeater. Typically, fiber optic repeaters and RF repeaters can have different types of signal influence problems. The present disclosure will focus on RF signal transmission technology pertaining to signal transmission and reception via an air interface.

An essential part of wireless or mobile communications includes antenna systems employing different types of antennas. Mobile communications involve the transmission and reception of radio frequency (RF) waves having high frequencies. A base station typically includes a transmitter antenna, a receiver antenna, a digital processing part and an amplifier or analog processing part. A transmitter antenna converts electrical signals into airborne radio frequency (RF) waves, while a receiver antenna converts airborne RF waves into electrical signals. A repeater can have a similar structure as a base station, but do not include a digital processing part. Signals are merely amplified by an amplifier or analog processing part. Typically, a repeater can have a donor antenna and a distributor (or coverage) antenna, which can each transmit and receive signals to and from the base station.

A repeater can consist of various components required for transmitting and receiving signals between a mobile station and a base station. An important part of a repeater is an antenna assembly A as shown in FIG. 1A.

For example, a conventional repeater antenna assembly A includes a radiator/receiver array 1 having a plurality of radiator elements or modules that can receive signals of different polarizations. Typically, the radiator/receiver array 1 is mounted in front of a rectangular reflector plate 3 so that signal transmission and reception is improved. The front portion of the reflector plate 3 having the radiator/receiver array 1 mounted thereto faces towards the direction of the desired signal transmission and reception. A cover (not shown) is typically placed over the front portion of the reflector plate 3 to protect the radiator/receiver array 1.

Conventional repeater antenna assemblies for mobile communications have rectangular reflector plates 3 that are flat and made of a conductive material such as metal. The flat rectangular reflector plate 3 is positioned so that its longer side is approximately vertical to the horizon as shown in FIG. 1A. As such, the reflector plate has a length (vertical height) and a width (breadth). The length is of an appropriate dimension to allow signal transmission and reception in the vertical direction, while the width is of an appropriate dimension to allow signal transmission and reception in the horizontal direction.

Also, in a conventional repeater antenna assembly A, the flat rectangular reflector plate 3 having the radiator/receiver array 1 is attached to a support pole 5 via a fixing means 7, as shown in FIG. 1A. Typically, the support pole 5 is made of steel or other metal that provides sufficient strength to hold up the reflector plate 3 and radiator/receiver array 1, while being resistant to wind loading. In general, the fixing means 7 is also made of metal to provide secure attachment of the reflector plate 3 to the support pole 5.

Additionally, the conventional repeater antenna assembly A includes a feed network (feeder) 9 electrically connected with the radiator/receiver array 1 via cables and wires for providing electrical signals thereto.

Typically, the cables and wires of the feed network 9 are connected with the radiator/receiver array 1 from behind the reflector plate 3, as shown in FIG. 1A.

For conventional mobile communications systems, a repeater system can have at least one repeater functioning as a receiver antenna (e.g., a donor antenna) and at least another repeater functioning as a transmitter antenna (e.g., a coverage antenna). The donor antenna sends and receives signals to and from the base station, while the coverage antenna sends and receives signals to and from the mobile station.

DISCLOSURE OF THE INVENTION

A gist of the present invention involves the recognition by the present inventors of the drawbacks in the conventional art. In particular, conventional antenna assemblies (of for example, a repeater) are problematic in that certain elements therein undesirably influence the function of the other elements that comprise an antenna system.

Here, the present inventors recognized that the signals from the donor antenna may be induced into the coverage antenna, or vice versa, to undesirably cause a phenomena called "loop" formation. In other words, the feedback (or positive feedback) of a signal from one antenna degrades the performance of another antenna located nearby. From a different point of view, the problem of the so-called loop formation is related to the concept of "isolation" for each antenna, explained further below.

Namely, due to the structure of the conventional antenna assembly A (of for example, a repeater) having a flat rectangular plate reflector 3, the resulting RF pattern has "loop" formations with substantial side lobe portions and back lobe portions, as shown in FIG. 1B. The edges of the flat rectangular reflector plate 3 cause the RF signal waves to scatter to the sides and back portions thereof, resulting in the creation of the side and back lobes. In particular, the conventional antenna assembly causes relatively large back lobe RF patterns at the backside of the antenna assembly, which are especially problematic in antenna performance. Here, the side lobes can be represented by a front-to-side ratio (FTSR) and the back lobes can be represented by a front-to-back ratio (FTBR).

Also, the present inventors recognized that the signals and radiation emitted from the power cable of the feed network (feeder) 9 connected to the radiator/receiver array 1 from behind the reflector plate 3 causes undesirable feedback of signals, and contribute to the formation of undesirable back lobe RF patterns. Additionally, the conductive nature of the metallic support pole 5 and the metallic fixing means 7 further contribute to the formation of undesirable back lobe RF patterns as shown in FIG. 1B.

Thus, in a conventional antenna assembly structure, the signals from the donor and coverage antennas cause undesirable influence with each other (e.g., loop formation phenomena due to the feedback of signals), especially due to the undesirably large back lobe RF patterns. To prevent such undesirable influence (e.g., positive feedback of signals), the donor antenna and coverage antennas must be sufficiently isolated electrically or isolated spatially from each other.

For example, the donor antenna is placed at a distance of over tens of meters (e.g., over 20 or 30 meters) from the coverage antenna to achieve the desired signal influence prevention. Alternatively, a large obstruction or barrier is placed between the donor and coverage antennas to prevent signal influence therebetween.

However, placing the antennas (e.g., donor and coverage) far apart within a wireless communications system is inappropriate for relatively small areas, such as in a downtown city environment. Also, placing an obstruction or barrier between the antennas increases installation costs and causes cumbersome set up procedures.

Thus, to address at least the above-identified conventional problems, the present inventors employ a particular antenna assembly structure that effectively minimizes signal influence (e.g., loop formation phenomena and the positive feedback of signals) in a wireless communications system. Namely, signal influence to and from an antenna assembly is minimized by providing a particular antenna assembly structure having at least one attenuating structural element (e.g., an attenuating member, plate, bent panel, wing, etc.) placed behind a reflecting member (reflector) using a non-conductive material for the antenna support structure, wrapping a conductive (e.g., metallic) mesh on a power cable of the feed network (feeder), or any combination of the above.

MODES FOR CARRYING OUT THE PREFERRED EMBODIMENTS

The present invention provides a wireless communications system involving transmission of signals from a network to a user via an air interface. For example, the wireless communications system may be a mobile communications system, where the network is a communications network and the user is a mobile station.

The present invention provides an improved antenna assembly structure that minimizes signal influence between antennas by reducing the RF pattern back lobes created by the antennas. Here, it should be noted that transmitted signals exhibit several types of signal characteristics, such as direct field, reflection, diffraction, scattering, and the like. Of these characteristics, signal diffraction and scattering mainly contribute to the formation of undesirable back lobes. As such, the present inventors have found that minimizing signal diffraction and scattering effectively reduces signal influence between antennas, e.g., loop formation phenomena caused by (positive) feedback of signals.

The following embodiments of the present invention are exemplified for an antenna assembly used in wireless communications. However, the present invention may also be appropriately implemented to other types of antennas, such as those used in base station systems, that may exhibit the aforementioned loop formation phenomena caused by (positive) feedback of signals by the antenna. In other words, the present invention applies to any antenna system that may suffer from the convention problems related to signal diffraction and scattering that would result in loop formation phenomena caused by (positive) feedback of signals.

The present invention can be implemented in a wireless communications system, such as a mobile communications system including a variety of elements, such as a communications network, at least one base station, at least one base station controller (BSC), a plurality of mobile stations, etc., and other components known to those having ordinary skill in the art.

For example, each base station is connected to the communications network, typically by a wire line link. A base station is also linked with the mobile stations via an air interface. The base station allows the mobile stations to be linked with the communications network, and is controlled by the base station controller. A repeater may be linked with a base station and mobile stations for boosting and/or relaying signals therebetween.

Thus, the present invention can provide a wireless communications system having a base station connected to a communications network and linked with mobile stations via an air interface, wherein the system comprises a particular antenna assembly providing a signal link between the communications network and the mobile stations. In particular, the antenna assembly comprises an antenna structure, a support structure, and a feeder, which will be explained in more detail below.

Figure 2A:
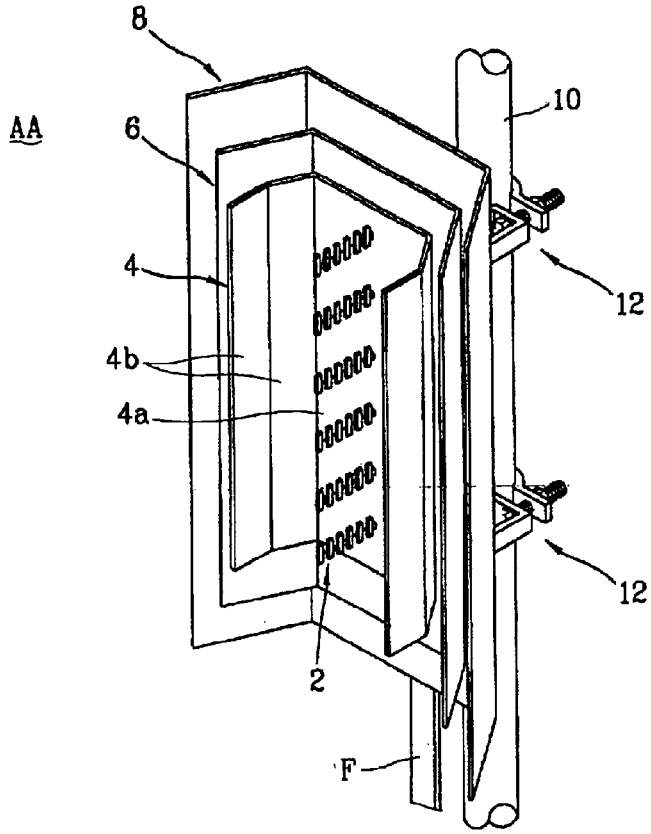
FIG. 2A shows a perspective view of an antenna assembly structure according to a first embodiment of the present invention.

FIG. 2A shows a perspective view of a first embodiment of the present invention. An antenna assembly AA consists of a radiator (or antenna) array 2 having a plurality of radiator (or antenna) elements or modules that can transmit signals of different polarizations. Here, the radiator elements may consist of single or double dipoles with various shapes and configurations, Yagi antenna elements, or other types of radiators depending upon the characteristics of the signals to be transmitted and received in a particular mobile communications system.

The radiator array 2 is mounted in front of a reflector 4 (e.g., a reflecting member, plate, etc.) so that signal transmission and reception is improved. The front portion of the reflector 4 having the radiator array 2 mounted thereto faces towards the direction of the desired signal transmission and reception. A cover (not shown) can be placed over the front portion of the reflector 4 to protect the radiator array 2.

As an example, FIG. 2A depicts a radiator array 2 with six radiator modules, each comprising six radiator elements positioned in-line and extending from the surface of the reflector 4. The six radiator modules are aligned with one another in a vertical manner. Depending upon the signal beam width and other signal characteristics that are desired from the antenna, the number, spacing and arrangement of the radiator modules can be varied. For example, instead of having a single column of six radiator modules, a total of twelve radiator modules arranged in two columns, each column having six radiator modules can be mounted to the reflector 4 to obtain a wider signal beam width.

The antenna assembly AA of the present invention has an elongated reflector 4 with a main (reflector) plate 4*a* and wings 4*b* along its vertical length (height). Each wing 4*b* comprises an inner portion extending from the edges of the reflector plate 4*a* and an outer portion extending from the inner portion, as shown in FIG. 2A. Here, it should be noted that the outer portion of the wing 4*b* can be approximately perpendicular to the reflector plate 4*a* portion of the reflector 4.

The reflector 4 can be made of a conductive material such as metal, and can be positioned so that its longer side is approximately vertical to the horizon as shown in FIG. 2A. As such, the reflector 4 has a length (vertical height) and a width (breadth). The length is of an appropriate dimension to allow signal transmission and reception in the vertical direction, while the width is of an appropriate dimension to allow signal transmission and reception in the horizontal direction.

Additionally, at least one attenuating structural element (e.g., attenuating member, plate, bent panel, wing, etc.) is mounted behind the reflector 4. According to the first embodiment shown in FIG. 2A, two attenuators (e.g., attenuating members, plates, bent or winged panels, etc.) are mounted behind the reflector 4.

In the antenna assembly AA of the first embodiment, the reflector 4 having the radiator array 2 is attached to a support pole 10 via a fixing means 12, as shown in FIG. 2A. Here, the support pole 10 is made of a non-conductive material that provides sufficient strength to hold up the reflector 4 and attenuators 6, 8 and the radiator array 2, while being resistant to wind loading, forces of nature and other physical conditions that may be applied on the antenna assembly. Also, the fixing means 12 is preferably made of a non-conductive material to provide secure attachment of the reflector 4 and attenuators 6, 8 to the support pole 10.

The antenna assembly (e.g., of a repeater) according to the present invention includes a feed network (feeder) F electrically connected with the radiator array 2 through the rear portions of the reflector 4 and attenuators 6, 8. The feed network F includes a power cable 14 and wires W (not visible in FIG. 2A).

The signals and radiation emitted from the power cable 14 of the feed network F connecting with the radiator array 2 from behind the reflector 4 and attenuators 6, 8 are effectively suppressed by the metallic mesh 16*a* (not visible in FIG. 2A) that wraps the power cable 14. Additionally, the non-conductive nature of the support pole 10 and the fixing means 12 further suppress the formation of the back lobe RF patterns.

Figure 1A:
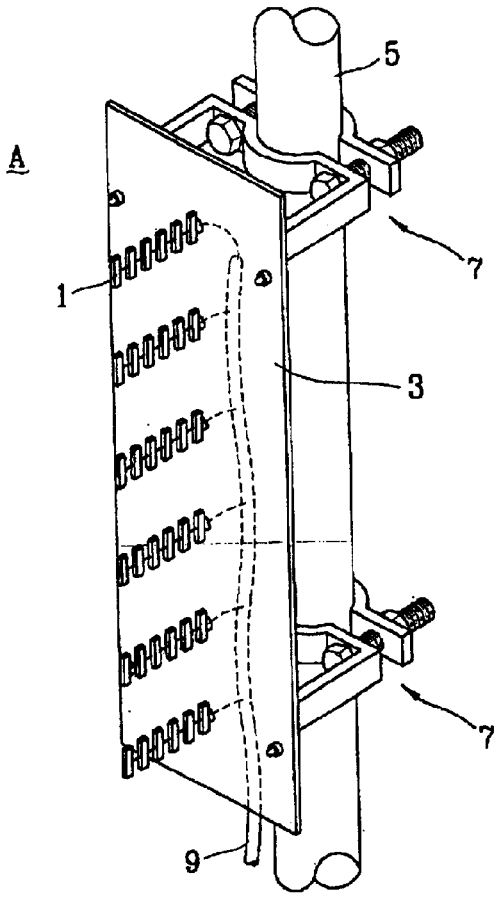
FIG. 1A CONVENTIONAL ART
FIG. 1A shows a perspective view of an antenna assembly (e.g., of a repeater) structure according to the conventional art.
Figure 1B:
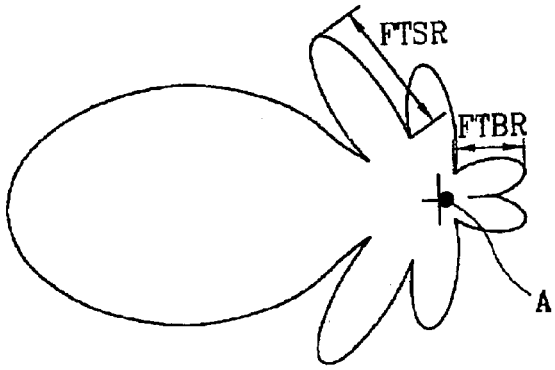
FIG. 1B CONVENTIONAL ART
FIG. 1B shows an RF pattern generated by the conventional antenna assembly structure of FIG. 1A.
Figure 2B:
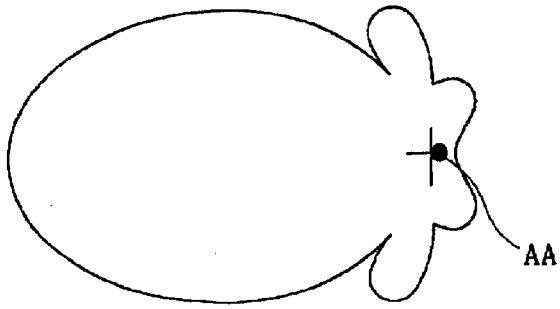
FIG. 2B shows an RF beam pattern generated by the antenna assembly structure of FIG. 2A according to the present invention.

FIG. 2B shows the RF pattern generated by the antenna assembly structure AA according to the first embodiment of the present invention. Namely, the wings 4*b* of the reflector 4, the two attenuators 6, 8, the metallic mesh 16*a*, the non-conductive support pole 10 and the fixing means 12, or any combination thereof can effectively prevent RF signal waves from scattering at the sides and back portions of the antenna assembly. Thus, only minimal side and back lobes are created, compared with the conventional art reflector plate 3 shown in FIG. 1A. In other words, the undesirable influence, e.g., the loop formation phenomena due to the feedback of signals, is effectively suppressed or at least minimized by the particular antenna assembly according to the present invention.

The particular structure of the reflector 4 and attenuators 6, 8, the feed network F and the support structure 10, 12 will be explained in more detail with reference to FIGS. 3 though 5.

Figure 3:
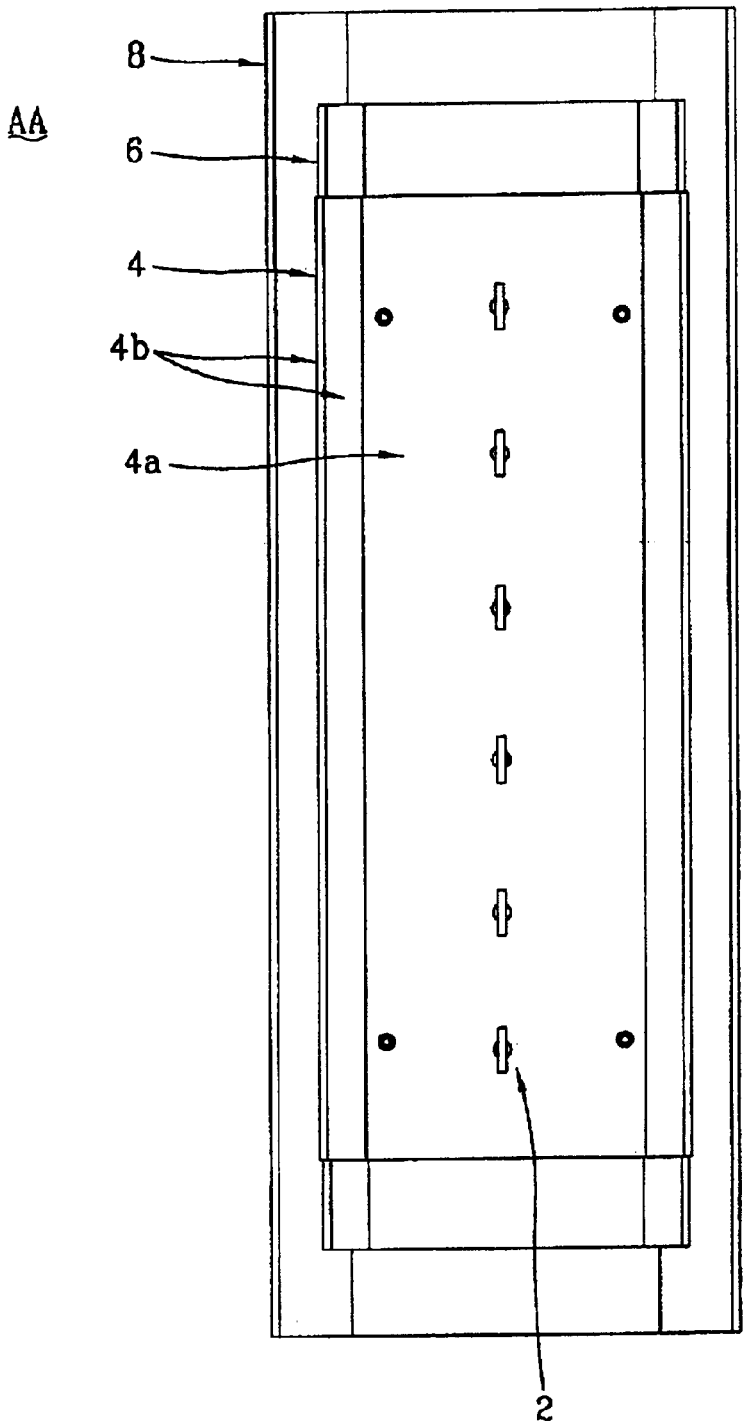
FIG. 3 shows a front view of the antenna assembly structure of FIG. 2A, viewed perpendicularly towards the reflector plate.

FIG. 3 shows a front portion of the reflector 4 and attenuators 6, 8 viewed perpendicularly towards the reflector plate 4*a* of the reflector 4, according to the first embodiment of the present invention.

It can be seen that the vertical height of the first attenuator 6 can be greater than that of the reflector 4. Namely, the vertical top and bottom portions of the first attenuator 6 can extend out further than the vertical top and bottom portions of the reflector 4.

Similarly, the vertical height of the second attenuator 8 can be greater than that of the first attenuator 6. Namely, the vertical top and bottom portions of the second attenuator 8 can extend out further than the vertical top and bottom portions of the first attenuator 6.

However, the particular vertical heights of the attenuating members may be varied depending upon the particular characteristics of the antenna assembly and wireless (or mobile) communications environment.

Figure 4:
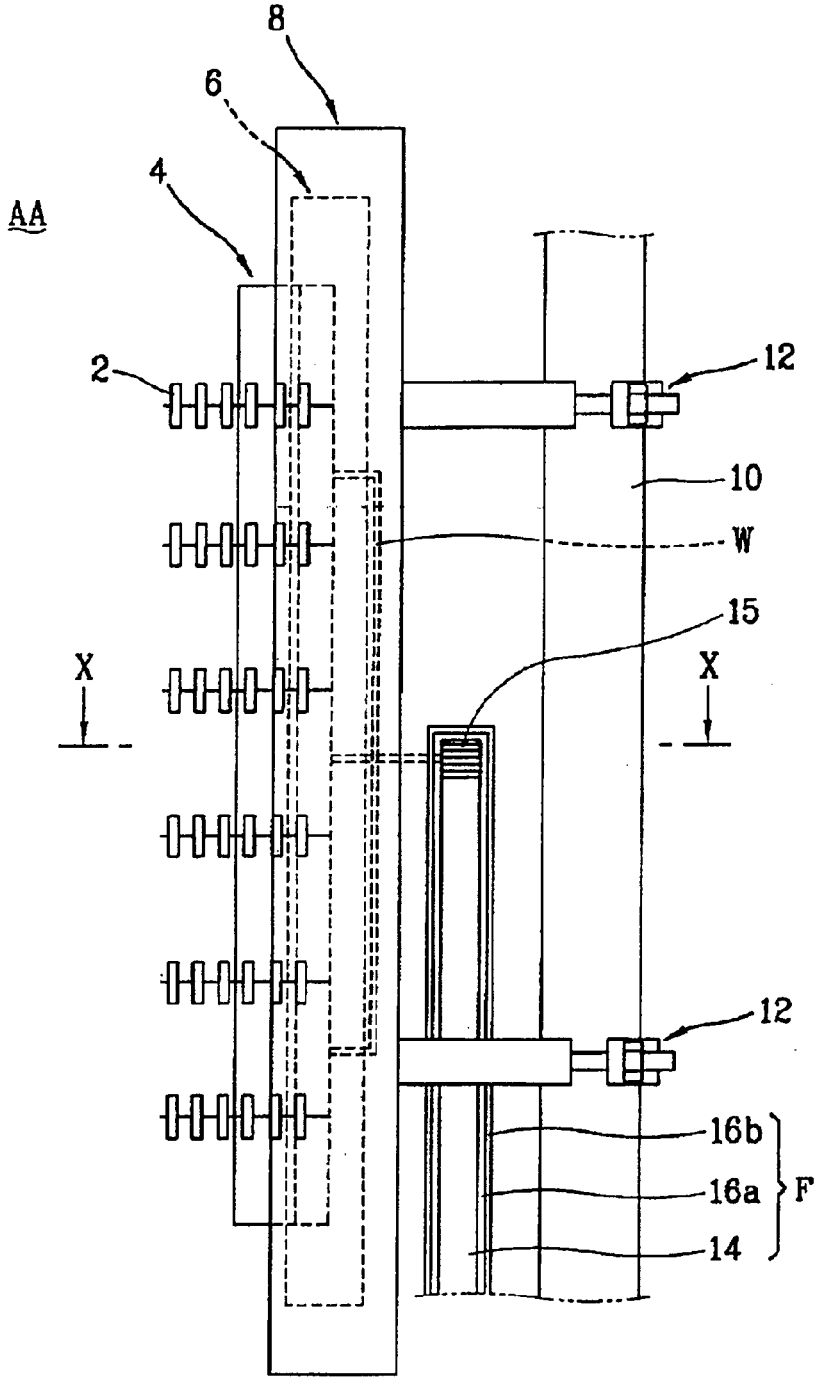
FIG. 4 shows a side view of the antenna assembly structure of FIG. 2A.

FIG. 4 shows a side view of the antenna assembly structure AA according to the first embodiment of the present invention. The vertical height relationship of the reflector 4 and the two attenuators 6, 8 is shown.

The antenna assembly (of for example, a repeater) according to the present invention also includes a feed network (feeder) F electrically connected with the radiator array 2 via a power cable 14 and wires W for providing electrical signals to the radiator array 2. Here, the feed network F feeds each radiator of the radiator array 2 with a defined power and phase, and performs compensation for different phase relationships between various radiators.

The power cable 14 and wires W of the feed network F can be connected with the radiator array 2 from behind the reflector 4 and attenuators 6, 8. Here, the power cable 14 is wrapped with a metallic mesh 16*a* to effectively suppress the leaking of signals and radiation emitted from the power cable 14. A tubing 16*b* provides further protection for the power cable 14 wrapped with the metallic mesh 16*a*. The feed network (feeder) F can include a power connector 15 that connects the wires W with the power cable 14.

Figure 5:
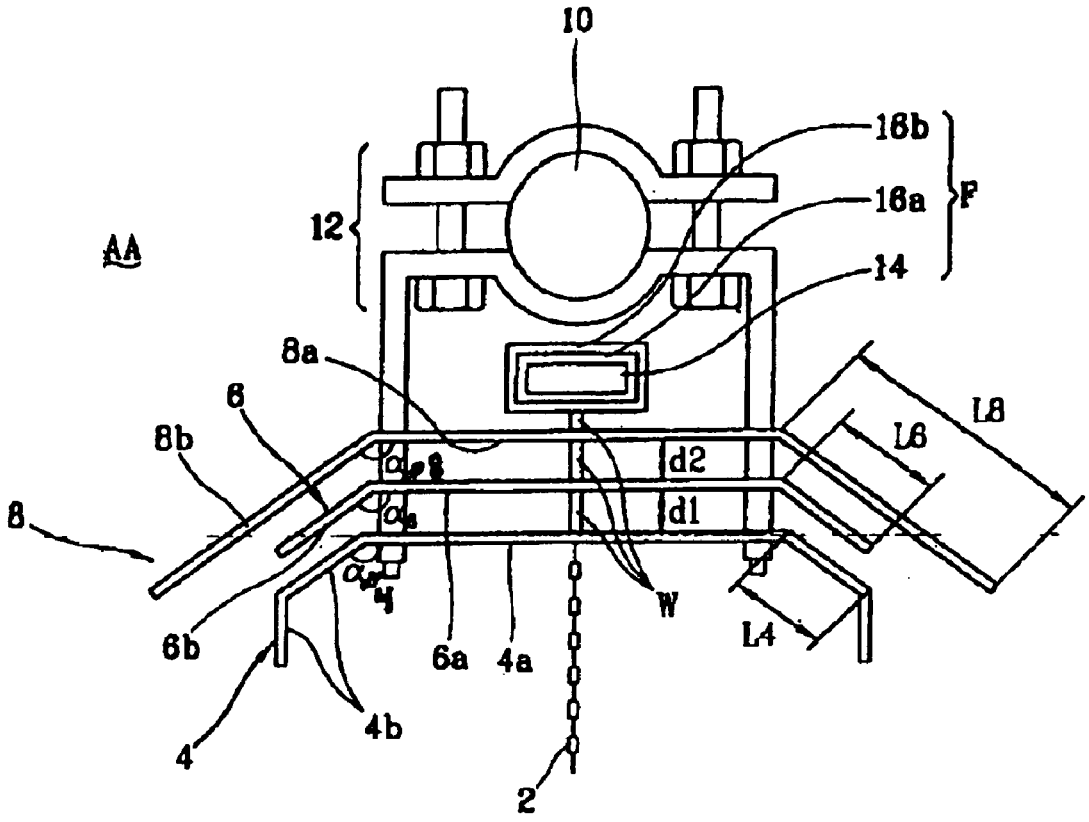
FIG. 5 shows a cross-section of the antenna assembly structure along the dotted line X—X of FIG. 3, viewed perpendicularly from above the antenna assembly structure.

FIG. 5 is a cross-sectional view of the antenna assembly structure taken along line X—X of FIG. 4. The connective relationship between the reflector 4 and attenuators 6, 8, the feed network F, the support 10 and the fixing means 12 is clearly shown.

It should be noted that the wings of each reflector 4 and attenuator 6, 8 have a particular configuration. As explained previously with regard to FIG. 2A, the reflector 4 has a reflector plate 4*a* and wings 4*b* formed along the vertical edges of the reflector plate 4*a*. Each wing 4*b* has an inner portion extending from the edges of the reflector plate 4*a* and an outer portion extending from the inner portion.

The outer portion is approximately perpendicular to the reflector plate 4*a*. *The inner portion of each wing* 4*b* is at an angle (e.g., an obtuse angle $\alpha_4$) with the reflector plate 4*a*. Here, the particular value of the obtuse angle $\alpha$ for the reflector 4 depends upon the desired signal beam width obtained when transmitting and receiving signals from and by the antenna assembly.

It should be noted that the two attenuators 6, 8 also have wings 6*b* and 8*b* that are at an obtuse angle $\alpha_6$ and $\alpha_8$ with its particular attenuator plates 6*a* and 8*a*, respectively. Preferably, all the obtuse angles $\alpha_4$, $\alpha_6$ and $\alpha_8$ for the reflector 4 and attenuators 6, 8 are the same. The present inventors have found that doing so provides the preferred signal scattering and diffraction blockage effect, so that the undesirable influence between antennas (e.g., loop formation phenomena due to the feedback of signals) can be minimized.

Here. It should be noted that transmitted signals exhibit several types of signal characteristics, such as direct field, reflection, diffraction, scattering, and the like. Of these characteristics, signal diffraction and scattering mainly contribute to the formation of undesirable back lobes. Thus, reducing signal diffraction and scattering effective minimizes the undesirable loop formation phenomena caused by (positive) feedback of signals.

Also, regarding the wing 4*b*, the inner portion has a particular length $L_{4i}$ and the outer portion each has a particular length $L_{4o}$. These lengths also depend upon the preferred signal scattering blockage desired from the antenna. It should be noted that these lengths should be at least $\lambda/4$ to be sufficient for blocking, i.e., preventing scattering and diffraction of signals, where $\lambda$ is the wavelength of the transmitted or received signal.

The attenuators 6, 8 also have wings, respectively. Each wing of the first attenuator 6 has a length $L_6$, while each wing of the second attenuator 8 has a length $L_8$, as shown in FIG. 5. Preferably, the length $L_6$ is approximately equal to the length $L_{4i}$, while $L_8$ is greater than $L_6$, as indicated in FIG. 5. By providing two attenuators 6, 8 respectively having wings of lengths $L_8$ and $L_6$, the present inventors found that the RF pattern (e.g., the back lobes) generated by the reflector antenna assembly M of the present invention can be minimized.

Also, it should be noted that the attenuators 6, 8 are positioned behind the reflector 4 to have a gap therebetween. Here, the distance between the reflector 4 and the first attenuator 6 is indicated as $d_1$, and the distance between the first attenuator 6 and the second attenuator 8 is indicated as $d_2$, as shown in FIG. 5. The distances $d_1$ and $d_2$ depend upon depends upon the desired signal beam width obtained when transmitting and receiving signals from and by the antenna, and also depends upon how signal scattering and diffraction should be minimized. The present inventors have found that having the distances $d_1$ and $d_2$ to be equivalent provides the preferred signal scattering and diffraction blockage. However, various values for the distances $d_1$ and $d_2$ may provide sufficient signal scattering and diffraction blockage.

Regarding the angles ($\alpha_4$, $\alpha_6$ and $\alpha_8$), lengths ($L_{4i}$, $L_6$ and $L_8$), and gap distances ($d_1$ and $d_2$) explained above, their particular values not only depend upon the isolation and beam width characteristics of the antenna, but also depend upon the specific wavelengths of the signals transmitted and received by the antenna. Thus, the particular angles, lengths and gap distances of the desired antenna structure may be further adjusted and varied, but must nonetheless provide sufficient signal diffraction and scattering prevention according to the teachings of the present invention to minimize undesirable loop formation phenomena caused by (positive) feedback of signals.

Figure 6:
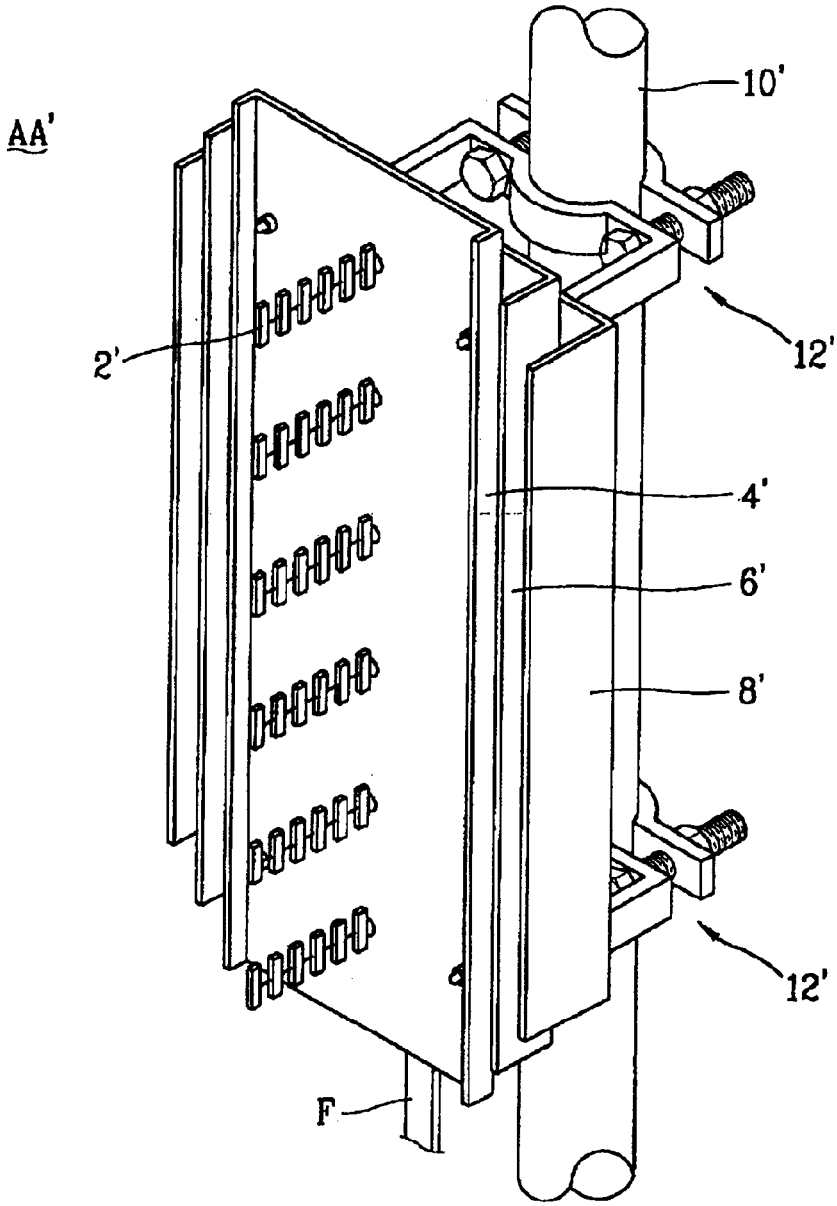
FIG. 6 shows a perspective view of an antenna assembly structure according to a second embodiment of the present invention.

FIG. 6 shows a perspective view of an antenna assembly structure AA' according to a second embodiment of the present invention. The second embodiment can comprise a radiator array 2', a reflecting member (reflector) 4', two attenuating members (attenuators) 6' and 8', a support 10', a fixing means 12' and a feed network (feeder) F. All components shown in FIG. 6 are similar to those shown in FIG. 2A, except for the particular structures of the reflector 4' and attenuators 6' and 8'.

In certain wireless communications systems, the signal communications requirements and conditions may be fulfilled by the particular structures of reflector 4' and attenuators 6', 8' of FIG. 6. The principles involved in signal scattering and diffraction prevention to minimize the side and back lobes in RF patterns generated by the antenna assembly are similar to those explained previously with respect to the first embodiment of the present invention. Namely, each reflector 4' and attenuator 6', 8' has a rim along its vertical edges, exhibiting similar effects as the wings of the reflector 4 and attenuators 6, 8 in the first embodiment.

The rims on the reflector 4' and attenuators 6', 8', along with a metallic mesh wrapping the power cable of the feed network F, the non-conductive support pole 10' and non-conductive fixing means 12', or any combination thereof as in the first embodiment of the present invention, have the effect of suppressing the scattering and diffraction of signal waves that would otherwise be created in a flat reflector plate antenna assembly structure A, such as that of the conventional art shown in FIG. 1A.

Accordingly, the present invention provides an antenna assembly for a wireless communications system comprising: a plurality of radiators transmitting radio signals; a first plate having the radiators mounted thereto, reflecting the radio signals; and a second plate mounted behind the first plate with a gap therebetween.

The present invention also provides an antenna assembly for a wireless communications system comprising: a plurality of antennas transmitting radio signals; a first plate having the antennas mounted thereto, reflecting the radio signals; a second plate mounted behind the first plate with a gap there between; a support structure supporting the first plate and the second plate; and a feeder connected with the radiators to allow transmitting of the radio signals.

The present invention also provides an antenna assembly for a wireless communications system comprising: a plurality of antennas transmitting radio signals; a reflector having the antennas mounted thereto, reflecting the radio signals; an attenuator mounted behind the reflector with a gap there between; a support structure supporting the reflector and the attenuator; and a feeder connected with the radiators to allow transmitting of the radio signals.

The present invention also provides an antenna assembly for a wireless communications system comprising: a plurality of radiators transmitting radio wave signals; a reflector having the radiators mounted thereto, reflecting the radio wave signals; and an attenuator mounted behind the reflector with a gap therebetween.

The present invention also provides an antenna assembly for a wireless communications system comprising: a plurality of radiators transmitting signals; a reflecting member having the radiators mounted thereto, reflecting the signals; and an attenuating member mounted behind the reflecting member with a gap therebetween.

The present invention also provides a wireless communications system having a base station connected to a communications network and linked with mobile stations via an air interface, the system comprising: an antenna assembly providing a signal link between the communications network and the mobile stations, the antenna assembly comprising, an antenna structure having a plurality of radiators mounted in front of a reflecting member, and at least one attenuating member mounted behind the reflecting member to have a gap therebetween; a support structure connected with and supporting the antenna structure, and a feeder connected with the radiators to allow transmitting and receiving of signals via the antenna structure.

The present invention also provides a wireless communications system involving transmission of signals from a network to a user via an air interface, the system comprising: an antenna assembly providing a signal link between the network and the user, the antenna assembly comprising, an antenna structure having a plurality of radiators mounted in front of a reflecting member, and at least one attenuating member mounted behind the reflecting member to have a gap therebetween; a support structure connected with and supporting the antenna structure; and a feeder connected with the radiators to allow transmitting and receiving of signals via the antenna structure.

Based upon at least the first and second embodiments of the present invention, the antenna assembly according to the present invention can be employed in a wireless communications system, for example, as donor and coverage antennas of a repeater system or other antennas employed in a mobile communications system. In a wireless communications system according to the present invention, the signals waves from the donor and coverage antennas cause only minimal influence to each other. Accordingly, the donor antenna and coverage antenna need not be separated far apart from each other.

As such, the donor antenna need not be placed at a distance of over tens of meters (e.g., over 20 or 30 meters) from the coverage antenna to achieve the desired signal interference prevention. Also, a large obstruction or barrier need not be placed between the donor and coverage antennas to prevent signal influence therebetween.

As a result, a wireless communications system employing the antenna assembly of the present invention can be installed in relatively small areas, such as in a downtown city environment. Also, the antenna assembly according to the present invention avoids the need for placing a large obstruction or barrier between two antennas (e.g., repeater antennas), thus installation costs can be minimal and no cumbersome set up procedures are needed.

This specification describes various illustrative embodiments of the present invention. The scope of the claims is intended to cover various modifications and equivalent arrangements of the illustrative embodiments disclosed in the specification. Therefore, the following claims should be accorded the reasonably broadest interpretation to cover modifications, equivalent structures, and features that are consistent with the spirit and scope of the invention disclosed herein.

What is claimed is:

1. An antenna assembly for a wireless communications system, the antenna assembly comprising:

a plurality of radiators transmitting radio signals;

a first plate having the radiators mounted thereto, and reflecting the radio signals, the first plate comprising a main plate and a wing extending from each longitudinal edge thereof, each wing comprising an inner portion and an outer portion, the inner portion at an obtuse angle with respect to the main plate and the outer portion substantially perpendicular to the main plate; and a second plate mounted behind the first plate with a gap therebetween.

2. The antenna assembly of claim 1, wherein the second plate comprises a main plate and a wing extending from each longitudinal edge thereof, the wing at an obtuse angle with respect to the main plate.

3. The antenna assembly of claim 2, wherein the obtuse angle of the second plate is the same as the obtuse angle of the first plate.

4. The antenna assembly of claim 3, wherein the inner portion of the wing of the first plate and the wing of the second plate are of the same width.

5. The antenna assembly of claim 1, further comprising a third plate mounted behind the second plate with a gap therebetween.

6. The antenna assembly of claim 5, wherein the gap between the second plate and the third plate is substantially equal to the gap between the first and second plates.

7. The antenna assembly of claim 1, further comprising:

a support structure supporting the first plate and the second plate, wherein at least a portion of the support structure is made of non-conductive material.

8. The antenna assembly of claim 1, further comprising:

a feeder connected to the radiators to facilitate transmitting the radio signals, wherein a portion of the feeder is shielded by conductive material.

9. An antenna assembly for a wireless communications system, the antenna assembly comprising:

a plurality of antennas transmitting radio signals;

a first plate having the antennas mounted thereto and reflecting the radio signals;

a second plate mounted behind the first plate with a gap therebetween, the second plate comprising a main plate and a wing extending from each longitudinal edge thereof, the wing at an obtuse angle with respect to the main plate;

a support structure supporting the first plate and the second plate; and a feeder connected to the radiators to facilitate transmitting the radio signals.

10. The antenna assembly of claim 9, further comprising a third plate mounted behind the second plate with a gap therebetween.

11. An antenna assembly for a wireless communications system, the antenna assembly comprising:

a plurality of antennas transmitting radio signals;

a reflector having the antennas mounted thereto and reflecting the radio signals;

an attenuator mounted behind the reflector with a gap therebetween, the attenuator comprising a main plate and a wing extending from each longitudinal edge thereof, the wing at an obtuse angle with respect to the main plate;

a support structure supporting the reflector and the attenuator; and a feeder connected to the radiators to facilitate transmitting the radio signals.

12. The antenna assembly of claim 11, further comprising a second attenuator mounted behind the attenuator with a gap therebetween.

13. An antenna assembly for a wireless communications system, the antenna assembly comprising:

a plurality of radiators transmitting radio wave signals;

a reflector having the radiators mounted thereto and reflecting the radio wave signals, the reflector comprising a main plate and a wing extending from each longitudinal edge thereof, each wing comprising an inner portion and an outer portion, the inner portion at an obtuse angle with respect to the main plate and the outer portion substantially perpendicular to the main plate; and an attenuator mounted behind the reflector with a gap therebetween.

14. The antenna assembly of claim 13, wherein the attenuator comprises a main plate and a wing extending from each longitudinal edge thereof, the wing at an obtuse angle with respect to the main plate.

15. The antenna assembly of claim 14, wherein the obtuse angle of the reflector is the same as the obtuse angle of the attenuator.

16. The antenna assembly of claim 15, wherein the inner portion of the wing of the reflector and the wing of the attenuator are of the same width.

17. The antenna assembly of claim 16, wherein the antenna structure further comprises a second attenuator mounted behind the attenuator with a gap therebetween.

18. The antenna assembly of claim 17, wherein the gap between the reflector and the attenuator is equal to the gap between the attenuator and the second attenuator.

19. The antenna assembly of claim 17, wherein the second attenuator comprises a main plate and a wing extending from each longitudinal edge thereof, the wing at an obtuse angle with respect to the main plate.

20. The antenna assembly of claim 19, wherein the obtuse angle of the second attenuator is the same as the obtuse angles of the reflector and the attenuator.

21. The antenna assembly of claim 13, further comprising:

a support structure supporting the reflector and the attenuator, wherein at least a portion of the support structure is made of dielectric substance.

22. The antenna assembly of claim 13, further comprising:

a feeder connected to the radiators to facilitate transmitting the radio wave signals, wherein a cable of the feeder is shielded by a conductive mesh.

23. An antenna assembly for a wireless communications system, the antenna assembly comprising:

a plurality of radiators transmitting signals;

a reflecting member having the radiators mounted thereto and reflecting the signals; and an attenuating member mounted behind the reflecting member with a gap therebetween, the attenuating member comprising a main plate and a wing extending from each longitudinal edge thereof, the wing at an obtuse angle with respect to the main plate.

24. The antenna assembly of claim 23, wherein the reflecting member comprises a main plate and a wing extending from each longitudinal edge thereof, each wing comprising an inner portion and an outer portion, the inner portion at an obtuse angle with respect to the main plate and the outer portion substantially perpendicular to the main plate.

25. The antenna assembly of claim 24, wherein the obtuse angle of the reflecting member is the same as the obtuse angle of the attenuating member.

26. The antenna assembly of claim 25, wherein the inner portion of the wing of the reflecting member and the wing of the attenuating member are of the same width.

27. The antenna assembly of claim 26, wherein the antenna structure further comprises a second attenuating member mounted behind the attenuating member with a gap therebetween.

28. The antenna assembly of claim 27, wherein the gap between the reflecting member and the attenuating member is equal to the gap between the attenuating member and second attenuating member.

29. The antenna assembly of claim 27, wherein the second attenuating member comprises a main plate and a wing extending from each longitudinal edge thereof, the wing an obtuse angle with respect to the main plate.

30. The antenna assembly of claim 29, wherein the obtuse angle of the second attenuating member is the same as the obtuse angles of the reflecting member and the attenuating member.

31. The antenna assembly of claim 23, further comprising:

a support structure supporting the reflecting member and the attenuating member, wherein at least a portion of the support structure is made of dielectric substance.

32. The antenna assembly of claim 23, further comprising:

a feeder connected to the radiators to facilitate transmitting the signals, wherein a cable of the feeder is shielded by a conductive mesh.

33. A wireless communications system having a base station connected to a communications network and linked with mobile stations via an air interface, the system comprising:

an antenna assembly providing a signal link between the communications network and the mobile stations, the antenna assembly comprising:

an antenna structure comprising a plurality of radiators mounted in front of a reflecting member, the reflecting member comprising a main plate and a wing extending from each longitudinal edge thereof, each wing comprising an inner portion and an outer portion, the inner portion at an obtuse angle with respect to the main plate and the outer portion substantially perpendicular to the main plate;

at least one attenuating member mounted behind the reflecting member with a gap therebetween;

a support structure connected to and supporting the antenna structure; and a feeder connected to the radiators to facilitate transmitting and receiving signals via the antenna structure.

34. The wireless communications system of claim 33, wherein the attenuating member comprises a main plate and a wing extending from each longitudinal edge thereof, the wing at an obtuse angle with respect to the main plate.

35. The wireless communications system of claim 33, wherein the antenna structure further comprises a first attenuating member and a second attenuating member, the first attenuating member mounted behind the reflecting member with a gap therebetween and the second attenuating member mounted behind the first attenuating member with a gap therebetween.

36. The wireless communications system of claim 35, wherein the gap between the reflecting member and the first attenuating member is equal to the gap between the first and second attenuating members.

37. The wireless communications system of claim 36, wherein the second attenuating member comprises a main plate and a wing extending from each longitudinal edge thereof, the wing at an obtuse angle with respect to the main plate.

* * * * *